US010753642B2

(12) United States Patent
Ono

(10) Patent No.: US 10,753,642 B2
(45) Date of Patent: Aug. 25, 2020

(54) COMBUSTION APPARATUS

(71) Applicant: RINNAI CORPORATION, Aichi (JP)

(72) Inventor: Takahiro Ono, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 153 days.

(21) Appl. No.: 16/211,477

(22) Filed: Dec. 6, 2018

(65) Prior Publication Data

US 2019/0186784 A1 Jun. 20, 2019

(30) Foreign Application Priority Data

Dec. 19, 2017 (JP) ..... 2017-242665

(51) Int. Cl.

| | |
|---|---|
| ***F23D 14/78*** | (2006.01) |
| ***F24H 1/14*** | (2006.01) |
| ***F24H 9/02*** | (2006.01) |
| ***F28F 1/14*** | (2006.01) |
| ***F23D 14/14*** | (2006.01) |
| ***F24H 9/18*** | (2006.01) |

(52) U.S. Cl.

CPC ..... *F24H 1/145* (2013.01); *F23D 14/14* (2013.01); *F24H 9/02* (2013.01); *F24H 9/1836* (2013.01); *F28F 1/14* (2013.01)

(58) Field of Classification Search

CPC ..... F23M 5/08; F23D 14/14; F23D 14/78; F23D 14/76; F24H 9/00; F24H 2210/00; F24H 1/14

See application file for complete search history.

(56) References Cited

U.S. PATENT DOCUMENTS

| | | | | |
|---|---|---|---|---|
| 10,527,279 | B2 * | 1/2020 | Ojiro | F24H 1/124 |
| 10,571,152 | B2 * | 2/2020 | Matsunaga | F23J 13/04 |
| 10,612,776 | B2 * | 4/2020 | Ono | F23D 14/14 |
| 2010/0116226 | A1 * | 5/2010 | Lovascio | F23D 14/02 122/367.1 |
| 2012/0301836 | A1 * | 11/2012 | Akagi | F23D 14/14 431/328 |
| 2014/0000534 | A1 * | 1/2014 | Naitoh | F23D 14/045 122/14.21 |
| 2019/0186785 | A1 * | 6/2019 | Ono | F23D 14/14 |
| 2020/0033002 | A1 * | 1/2020 | Karaki | F23N 5/12 |
| 2020/0072497 | A1 * | 3/2020 | Miura | F23D 14/14 |

FOREIGN PATENT DOCUMENTS

JP 2017-078542 A 4/2017

* cited by examiner

*Primary Examiner* — Gregory A Wilson
(74) *Attorney, Agent, or Firm* — Cermak Nakajima & McGowan LLP; Tomoko Nakajima

(57) ABSTRACT

A combustion apparatus has a burner including a burner body and a combustion plate, as well as a combustion box. A combustion plate flange part projects outward beyond an inner rim of a body flange part and beyond an inner rim of a combustion box flange part. The combustion box has, on a perimeter of one end, the combustion box flange part, adapted to be connected to the body flange part enclosing an open surface of the burner body. The combustion plate is provided with an inside projection which is erected, by bending, toward the body flange part so as to face the inner rim of the packing such that, in a state in which the combustion box flange part is connected to the body flange part, the outside projection and the inside projection are in contact with the body flange part.

4 Claims, 6 Drawing Sheets

COMBUSTION APPARATUS

TECHNICAL FIELD

The present invention relates to a combustion apparatus comprising: a burner made up of a burner body which is supplied therein with air-fuel mixture, and a combustion plate which covers an open surface of the burner body and which has an air-fuel mixture ejection part; and a combustion box which has, on a perimeter of one end, a combustion box flange part, adapted to be connected to a body flange part enclosing the open surface of the burner body, the combustion box containing therein a heat exchanger.

BACKGROUND ART

As this kind of combustion apparatus, there is known an apparatus in JP-A 2017-78542 having the following features. In other words, the combustion apparatus includes: a combustion plate flange part disposed on a perimeter of the combustion plate in a manner to project outward beyond an inner rim of the body flange part and beyond an inner rim of the combustion box flange part, and also in a manner that an outer rim of the combustion plate flange part is positioned inside an outer rim of the body flange part and inside an outer rim of the combustion box flange part; a packing having a portion interposed between the combustion plate flange part and the body flange part, and a portion interposed between the combustion box flange part and the body flange part outside the outer rim of the combustion plate flange part, such that the combustion box flange part is connected, with the packing being sandwiched therein, to the body flange part. According to this arrangement, the combustion plate flange part comes into direct contact with the combustion box flange part. Further, in that portion of the combustion box which lies between the burner and the heat exchanger, there is disposed cooling means such as water jackets and the like. Therefore, it is possible to release the heat of the combustion plate through the combustion plate flange part to the combustion box flange part to which the cold by the cooling means is transmitted.

By the way, in the arrangement as described in the above-mentioned prior art, the body flange part has formed therein a groove for mounting therein a packing (hereinafter referred to as "a packing mounting grove") so that the packing can be fixed in position. Here, in order for the body flange part to allow the packing mounting groove to be formed, the body flange part must be formed in a large plate thickness. In order to meet the above requirement, the burner body must be constituted by a die-cast article. This solution will result in an obstacle to an attempt to reduce the cost.

SUMMARY OF THE INVENTION

Problems that the Invention is to Solve

In view of the above-mentioned point, this invention has a problem of providing a combustion apparatus which is capable of fixing the packing in position in the body flange part without the necessity of forming a packing mounting groove in the body flange part, and which enables to make the burner body in a sheet metal.

Means for Solving the Problems

In order to solve the above problem, this invention is a combustion apparatus comprising: a burner made up of a burner body which is supplied inside thereof with air-fuel mixture, and a combustion plate which covers an open surface of the burner body and which has an air-fuel mixture ejection part; a combustion box which has, on a perimeter of one end, a combustion box flange part, adapted to be connected to a body flange part enclosing the open surface of the burner body, and which contains therein a heat exchanger. The combustion apparatus further comprises: a combustion plate flange part disposed on a perimeter of the combustion plate in a manner to project outward beyond an inner rim of the body flange part and beyond an inner rim of the combustion box flange part, and also in a manner that an outer rim of the combustion plate flange part is positioned inside an outer rim of the body flange part and inside an outer rim of the combustion box flange part; a packing having a portion interposed between the combustion plate flange part and the body flange part, and a portion interposed between the combustion box flange part and the body flange part outside the outer rim of the combustion plate flange part, such that the combustion box flange part is connected, with the packing being sandwiched therein, to the body flange part. The outer rim of the combustion box flange part is provided with an outside projection which is bent for erection toward the body flange part so as to face an outer rim of the packing, and the combustion plate is provided with an inside projection which is bent for erection toward the body flange part so as to face an inner rim of the packing such that, in a state in which the combustion box flange part is connected to the body flange part, the outside projection and the inside projection are in contact with the body flange part.

According to this invention, the packing is fixed in position by the outside projection and the inside projection. Therefore, even without forming a packing mounting groove in the body flange part, the packing can be fixed in position. As a result, it becomes possible to manufacture the burner body in sheet metal, thereby attaining a cost reduction. Further, as a result of contact of the outside projection and the inside projection with the body flange part, the compression allowance of the packing can be appropriately managed, and the workability in assembling work can be improved.

The combustion plate may be provided with a member having formed therein an inside projection. However, in case the combustion plate is provided with a distribution plate having formed therein a multiplicity of distribution holes for introducing the air-fuel mixture into the air-fuel mixture ejection part, it is preferable to form by bending the inside projection in an outer rim of the distribution plate. According to this arrangement, the distribution plate can be made to serve the dual purpose as a material in which the inside projection is formed, thereby reducing the number of constituting parts.

In this invention, preferably the combustion plate flange part may comprise a claw part formed by bending a part of the outer rim of the combustion plate flange part such that the claw part is inserted into a hole formed in the packing. According to this arrangement, the positioning accuracy of the packing can be improved.

EMBODIMENTS FOR CARRYING OUT THE INVENTION

Figure 1:
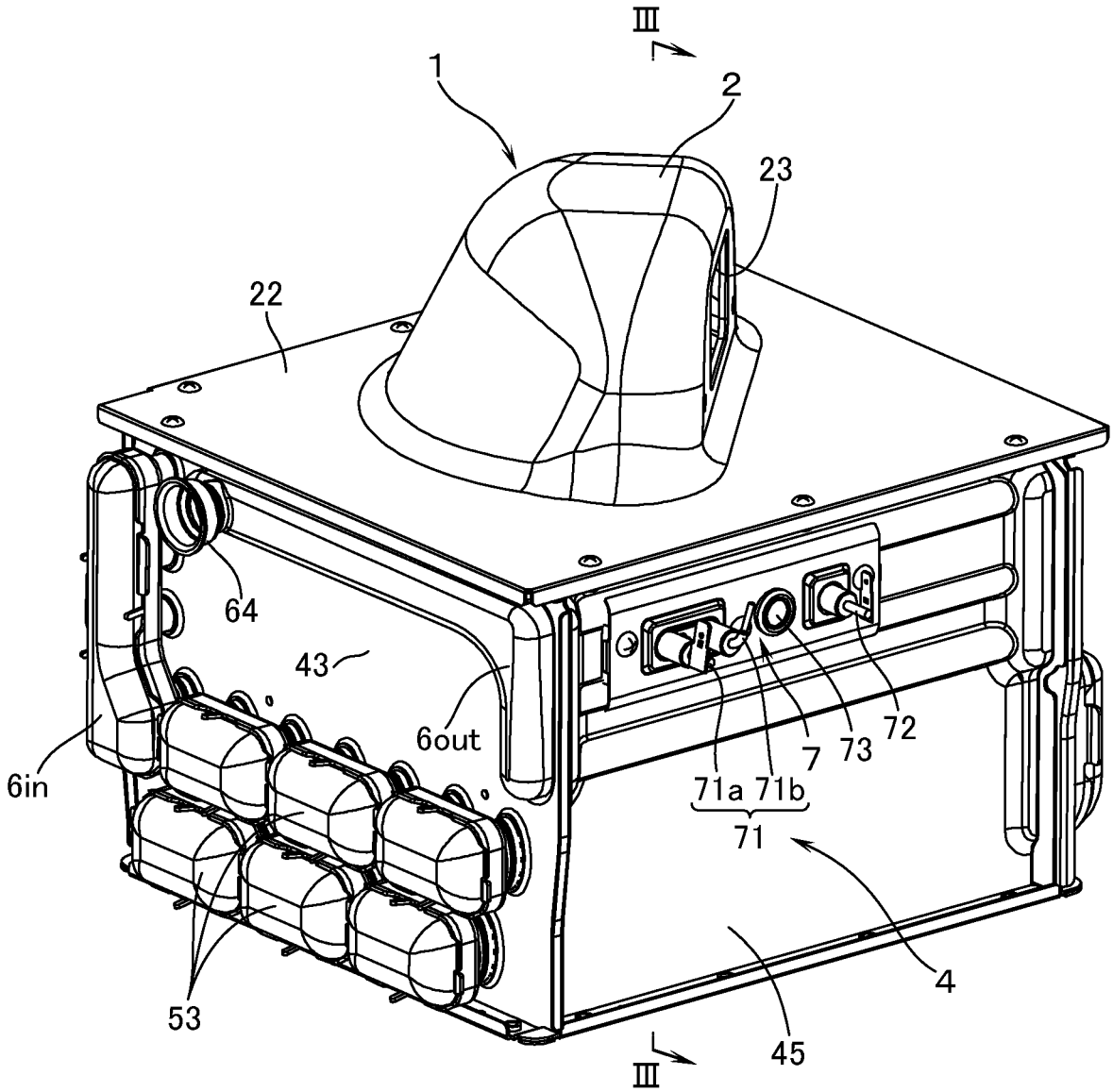
FIG. 1 is a perspective view of a combustion apparatus according to an embodiment of this invention.
Figure 2:
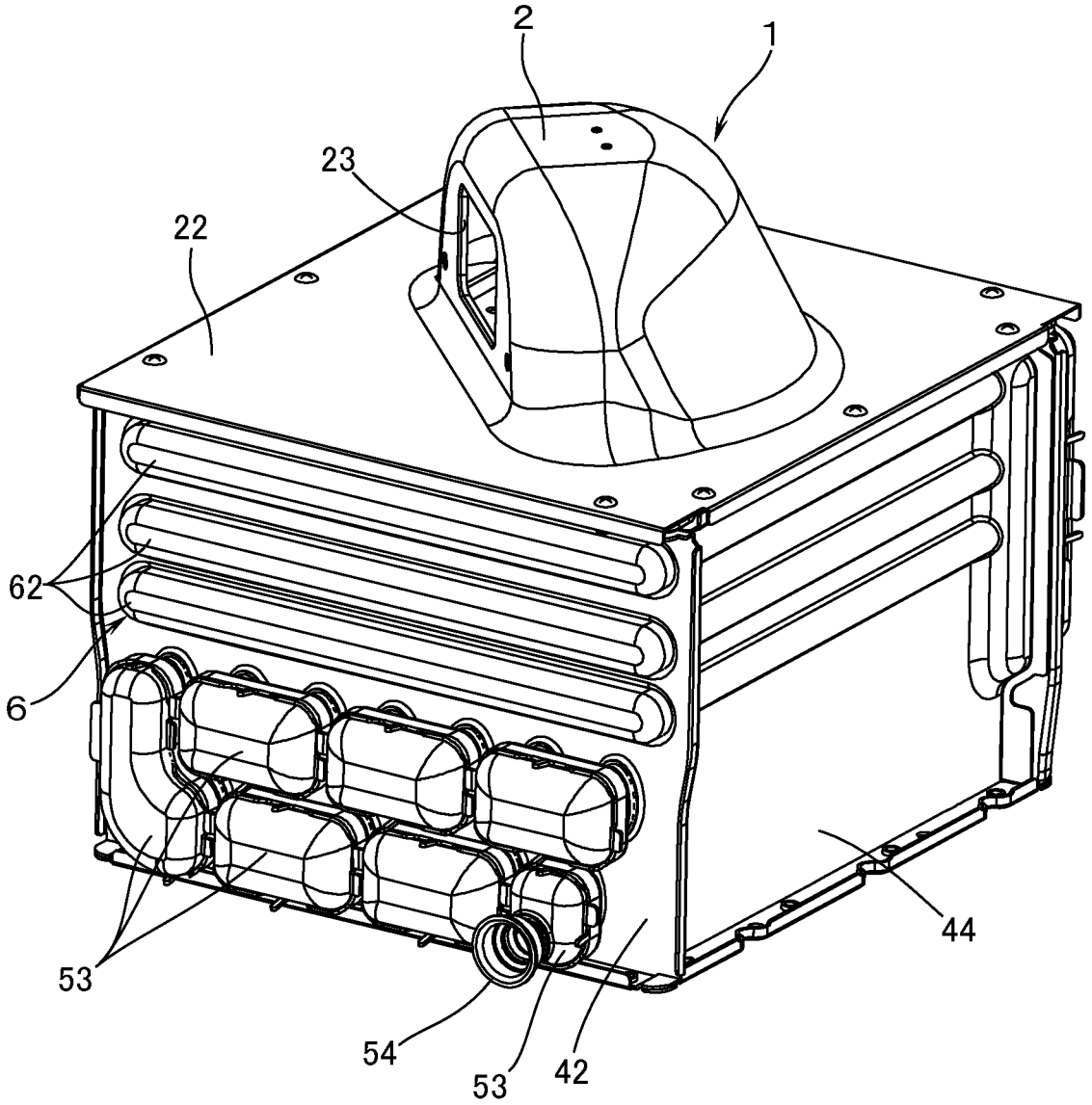
FIG. 2 is a perspective view of the combustion apparatus of the embodiment as viewed from a side opposite to that in FIG. 1.
Figure 3:
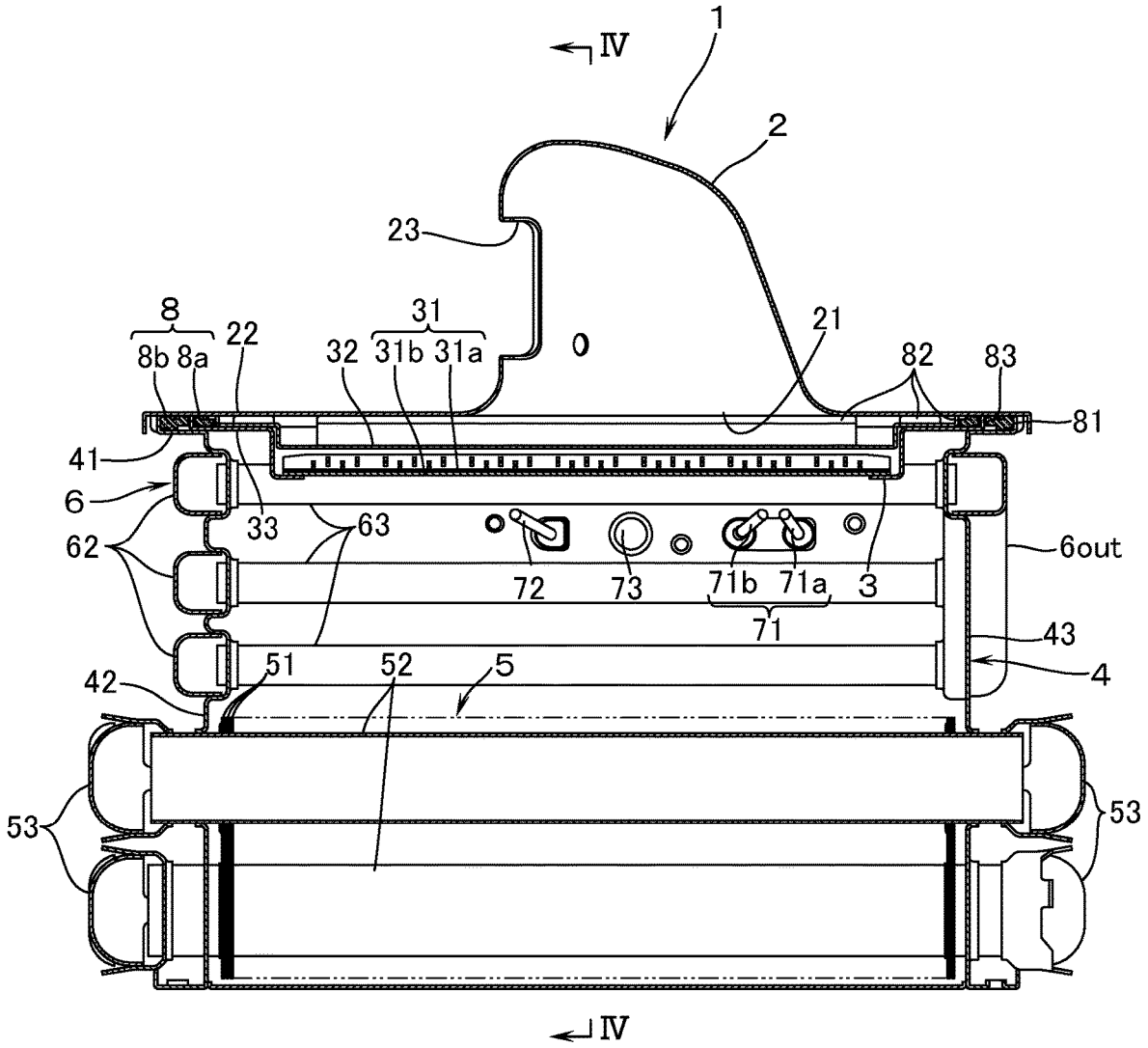
FIG. 3 is a sectional view cut away along the line III-III in FIG. 1.
Figure 4:
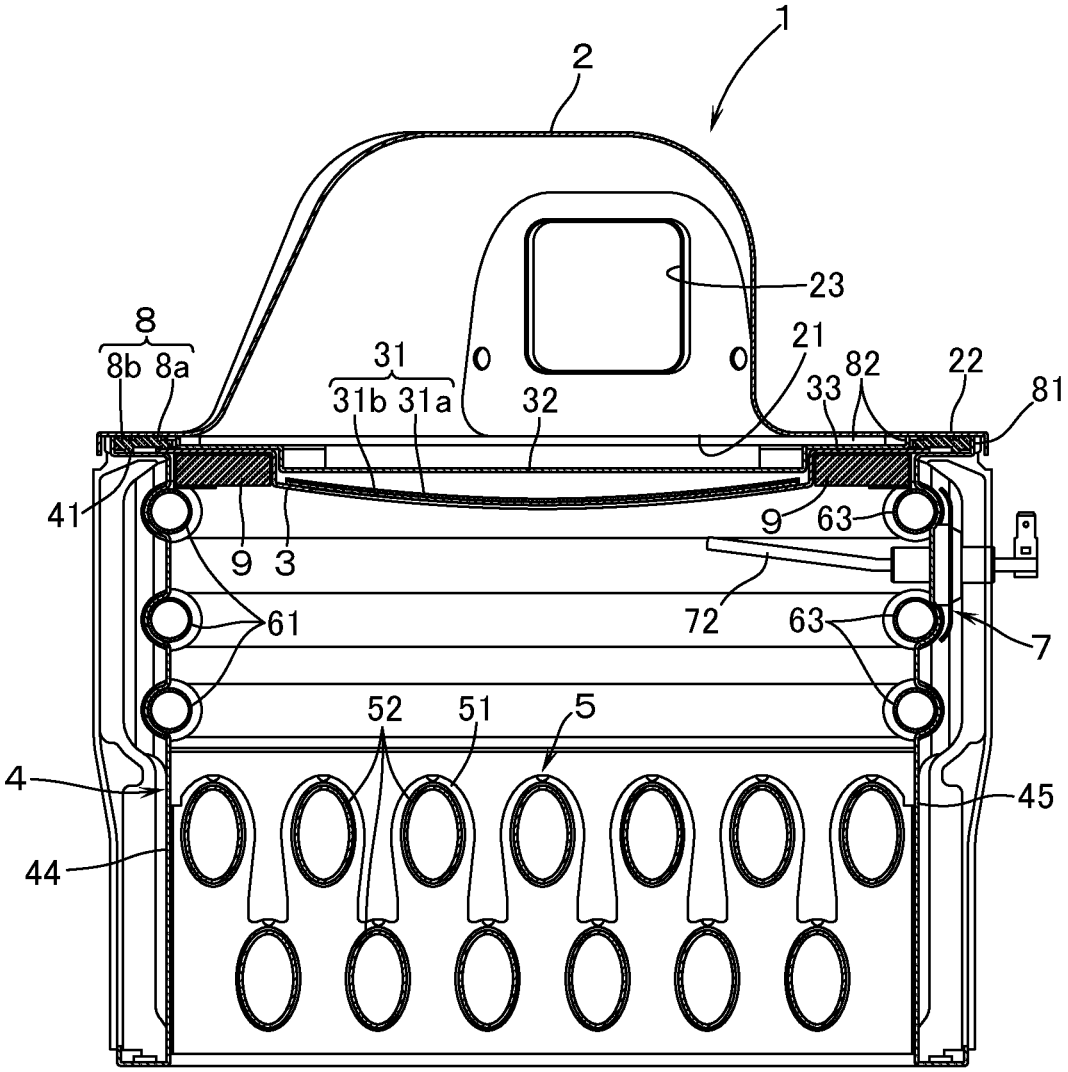
FIG. 4 is a sectional view cut away along the line IV-IV in FIG. 3.

With reference to FIG. 1 to FIG. 4, a combustion apparatus according to an embodiment of this invention is provided with: a burner 1 made up of a burner body 2 which is supplied inside thereof with air-fuel mixture (mixture gas of fuel gas and primary air), and a combustion plate 3, made of a sheet metal and having an air-fuel mixture ejection part 31, the combustion plate 3 covering a downward open surface 21 of the burner body 2; and a combustion box 4 of a sheet-metal make which has, on a perimeter of an upper end, a combustion box flange part 41 to be connected to a body flange part 22 which encloses the open surface 21 of the burner body 2. The combustion box 4 contains, inside thereof, a heat exchanger 5 for supplying hot water.

On a side surface of the portion swollen upward in the central part of the burner body 2, there is provided an inlet port 23 to which is connected a fan (not illustrated) for supplying air-fuel mixture. The combustion plate 3 has a large opening in the center thereof. This opening has mounted thereon a burner port plate 31*a* which has formed therein a multiplicity of burner ports in a manner overlapped on a lower surface with woven fabric 31*b* of heat-resistant fiber. The burner port plate 31*a* and the woven fabric 31*b* constitute the air-fuel ejection part 31. In addition, the combustion plate 3 is provided with a distribution plate 32 which has formed therein a multiplicity of distribution holes 32*a* (see FIG. 6) positioned above the burner port plate 31*a*. The air-fuel mixture supplied from the fan into the burner body 2 is introduced, through the distribution plate 32, into the air-fuel ejection part 31 for further ejection out of the air-fuel ejection part 31, thereby performing totally primary air combustion. The reason why the distribution plate 32 is disposed is, even if the space for distributing the air-fuel mixture inside the burner body 2 is narrowed for downsizing of the burner 1, to enable the air-fuel mixture to be evenly introduced into an entire region of the air-fuel mixture ejection part 31. By the way, it is also possible to form a multiplicity of burner ports in a combustion plate having no large opening, and an air-fuel mixture ejection part is constituted by these burner ports.

The heat exchanger 5 is constituted by a fin-tube type of heat exchanger having; a multiplicity of fins 51; and a plurality of heat-absorbing pipes 52 which penetrate through these fins 51. On the outside of side plates 42, 43 on laterally one side and the other side of the combustion box 4, there are disposed a plurality of connection boxes 53 which connect connection passages for the adjoining two heat-absorbing pipes 52, 52. All the heat-absorbing pipes 52 are thus connected in series with one another. In addition, the connection box 53 to be connected to the heat absorbing pipe 52 on the upstream end, is provided with a cold water inlet 54.

Further, in that portion of the combustion box 4 which lies between the burner 1 and the heat exchanger 5, there is disposed, as cooling means for cooling the combustion box 4, a water jacket 6 which is connected to the downstream side of the heat exchanger 5. This water jacket 6 is constituted by the following, i.e.: laterally elongated three pieces of first water tubes 61 vertically arranged on a back-side side plate 44 of the combustion box 4; laterally elongated three pieces of third water tubes 63 vertically arranged on a front-side side plate 45 of the combustion box 4; three pieces of second water tubes 62 which are disposed on laterally one of the side plates 42 of the combustion box 4 and which are vertically arranged to be elongated in front-to-back direction so as to connect the first water tubes 61 and the third water tubes 63 together; an inlet-side header 6in disposed on an outside of the portion toward the back side of the laterally other of the side plates 43 of the combustion box 4, so as to introduce the water passed through the heat exchanger 5; and an outlet-side header 6out disposed on an outside of the portion toward the front side of, and on an upper portion of, the side plate 43 on the laterally the other of the combustion box 4. The outlet-side header 6out is provided with a hot water outlet port 64 to which is connected a hot-water supply passage. Water (hot water) passed through the heat exchanger 5 flows from the inlet-side header 6in through the first water tube 61, the second water tube 62, and the third water tube 63 into the outlet-side header 6out, and is supplied from the hot water outlet port 64 to the hot water supply passage.

In addition, the front-side side plate 45 of the combustion box 4 has mounted thereon electrode parts 7 having: an ignition plug 71 made up of an ignition electrode 71*a* and a ground electrode 71*b*, both penetrating through the side plate 45 to project into the combustion box 4; and a flame rod 72. By the way, the electrode parts 7 are additionally provided with an inspection window 73 which enables visual confirmation inside the combustion box 4.

Figure 5:
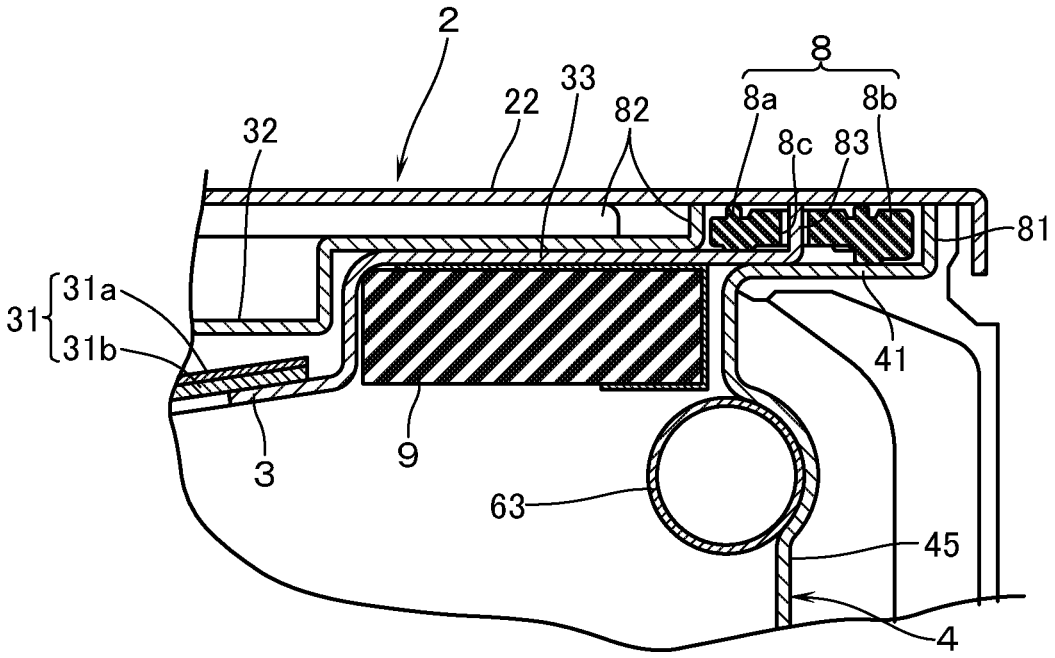
FIG. 5 is an enlarged sectional view of an essential part of the combustion apparatus of the embodiment.

As clearly shown in FIG. 5, on a perimeter of a combustion plate 3, there is provided a combustion plate flange part 33 which projects outward beyond an inner rim of the body flange part 22 and beyond an inner rim of the combustion box flange part 41, and an outer rim of the combustion plate flange part 33 is positioned inside an outer rim of the body flange part 22 and inside an outer rim of the combustion box flange part 41. And there is provided a packing 8 which has a portion 8*a* adapted to be interposed between the combustion plate flange part 33 and the body flange part 22 and a portion 8*b* adapted to be interposed between the combustion box flange part 41 and the body flange part 22 outside the outer rim of the combustion plate flange part 33. Further, it is so arranged that the combustion box flange part 41 is connected, with the packing being sandwiched therein, to the body flange part 22.

Here, according to this embodiment, the combustion plate flange part 33 will be brought into direct contact with the combustion box flange part 41. Therefore, the heat from the combustion plate 3 can be released to the combustion box flange part 41 to which the cold by the water jacket 6 is transmitted, and the temperature of the combustion plate flange part 33 is lowered. As a result, it becomes possible to use, as the packing 8, a relatively inexpensive one whose heat resistant temperature is relatively low.

By the way, on that lower surface of the combustion plate flange part 33 in a front and back of the combustion plate 3 which is on the inner side projecting into the combustion box 4, a thermal insulation material 9 is mounted. According to this arrangement, there will be restrained the input of that heat to the combustion plate flange part 33 from the combustion gas which is generated by the combustion of the air-fuel mixture.

Figure 6:
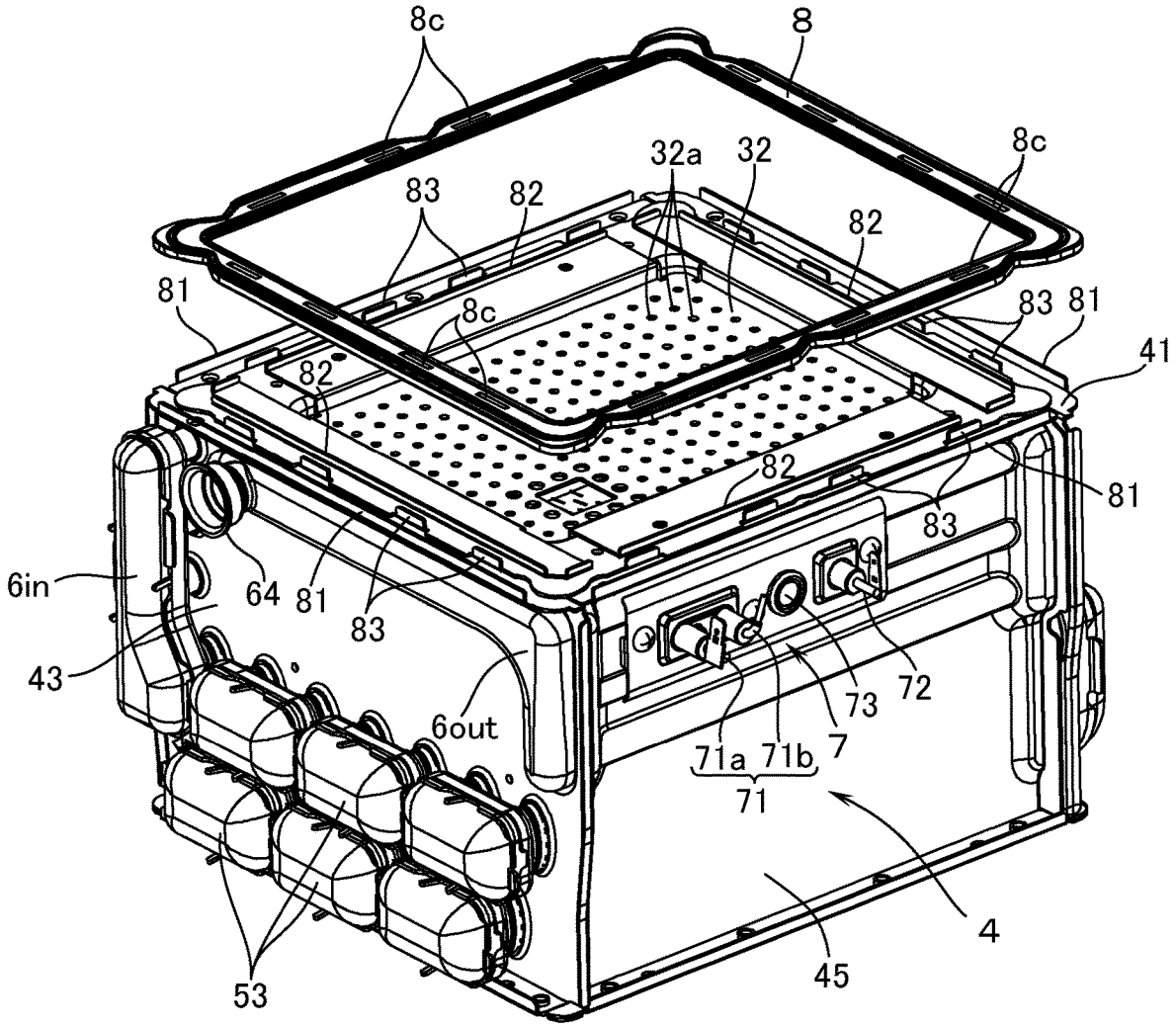
FIG. 6 is a perspective view in an exploded state (burner body being omitted) of the combustion apparatus according to the embodiment.

In addition, with reference to FIG. 5 and FIG. 6, in this embodiment, at the outer rim of the combustion box flange part 41 there is formed by bending an outside projection 81 which is erected toward the body flange part 22 so as to face an outer rim of the packing 8. Also the combustion plate 3 is provided with an inside projection 82 which is erected toward the body flange part 22 so as to face an inner rim of the packing 8. According to this arrangement, the packing 8 can be fixed in position by the outside projection 81 and the inside projection 82. It follows that it is not necessary to form a packing mounting groove in the body flange part 22. As a result, the burner body 2 may be made of a metal plate, thereby attaining a cost reduction.

Further, in this embodiment, in a state in which the combustion box flange part 41 is connected to the body flange part 22, the outside projection 81 and the inside projection 82 are arranged to come into contact with the body flange part 22. Therefore, by the contact of the outside projection 81 and the inside projection 82 with the body flange part 22, the compression allowance of the packing 8 can be appropriately managed, thereby improving the workability in the assembling work.

It may be possible to attach to the combustion plate 3 a member having formed therein the inside projection 82. However, in this embodiment, the inside projection 82 is formed by bending the outside rim of the distribution plate 32. Therefore, the distribution plate 32 can be made to serve the dual function as a material in which the inside projection 82 is formed, thereby reducing the number of constituting parts.

Further, in this embodiment, in a part of the outer rim of the combustion plate flange part 33, there are formed, by bending, claw parts 83 adapted to be inserted into openings 8*c* formed in the packing 8. According to this arrangement, the positioning accuracy of the packing 8 can be improved. By the way, in a state in which the combustion box flange part 41 is connected to the body flange part 22, the claw parts 83, together with the outside projection 81 and the inside projection 82, are brought into contact with the body flange part 22. The claw parts 83 thus contribute to the management of the compression allowance of the packing 8.

Descriptions have so far been made of embodiments of this invention with reference to the drawings. However, this invention shall not be limited to the above. For example, in the above embodiments, the combustion box 4 contains therein the heat exchanger 5 for hot water supply. Heat exchangers other than for the purposes of supplying hot water for space heating and the like, may also be contained in the combustion box 4. Further, in the above embodiments the burner body 2 has formed therein the open surface 21 looking downward. This invention is similarly applicable to a combustion apparatus in which the burner is disposed such that the open surface thereof looks upward.

EXPLANATION OF MARKS

1 burner
2 burner body
21 open surface
22 body flange part
3 combustion plate
31 air-fuel mixture ejection part
32 distribution plate
32*a* distribution hole
33 combustion plate flange part
4 combustion box
41 combustion box flange part
8 packing
8*a* packing portion to be interposed between the combustion plate flange part and the body flange part
8*b* packing portion to be interposed between the combustion box flange part and the body flange part
8*c* openings formed in the packing
81 outside projection
82 inside projection
83 claw part

The invention claimed is:

1. A combustion apparatus comprising:

a burner made up of: a burner body which is supplied inside thereof with air-fuel mixture, and a combustion plate which covers an open surface of the burner body and which has an air-fuel mixture ejection part;

a combustion box which has, on a perimeter of one end, a combustion box flange part, adapted to be connected to a body flange part enclosing an open surface of the burner body, and which contains therein a heat exchanger, the combustion apparatus further comprising;

a combustion plate flange part disposed on a perimeter of the combustion plate in a manner to project outward beyond an inner rim of the body flange part and beyond an inner rim of the combustion box flange part, and also in a manner that an outer rim of the combustion plate flange part is positioned inside an outer rim of the body flange part and inside an outer rim of the combustion box flange part;

a packing having a portion interposed between the combustion plate flange part and the body flange part, and a portion interposed between the combustion box flange part and the body flange part outside the outer rim of the combustion plate flange part, such that the combustion box flange part is connected, with the packing being sandwiched therein, to the body flange part;

wherein the outer rim of the combustion box flange part is provided with an outside projection which is bent for erection toward the body flange part so as to face an outer rim of the packing, and wherein the combustion plate is provided with an inside projection which is bent for erection toward the body flange part so as to face an inner rim of the packing such that, in a state in which the combustion box flange part is connected to the body flange part, the outside projection and the inside projection are in contact with the body flange part.

2. The combustion apparatus according to claim 1, wherein the combustion plate is provided with a distribution plate having formed therein a multiplicity of distribution holes for introducing the air-fuel mixture into the air-fuel mixture ejection part, and wherein the inside projection is formed, by bending, on an outer rim of the distribution plate.

3. The combustion apparatus according to claim 1, further comprising a claw part formed by bending a part of the outer rim of the combustion plate flange part such that the claw part is inserted into a hole formed in the packing.

4. The combustion apparatus according to claim 2, further comprising a claw part formed by bending a part of an outer rim of the combustion plate flange part such that the claw part is inserted into a hole formed in the packing.

* * * * *